US006783126B2

(12) United States Patent
Amamoto

(10) Patent No.: US 6,783,126 B2
(45) Date of Patent: Aug. 31, 2004

(54) SHEET FEEDER AND IMAGE FORMATION APPARATUS

(75) Inventor: Hidekazu Amamoto, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 28 days.

(21) Appl. No.: 10/200,232

(22) Filed: Jul. 23, 2002

(65) Prior Publication Data

US 2003/0116906 A1 Jun. 26, 2003

(30) Foreign Application Priority Data

Dec. 20, 2001 (JP) ..... 2001-388353

(51) Int. Cl.[7] ..... B65H 1/18
(52) U.S. Cl. ..... 271/152; 271/127; 271/160
(58) Field of Search ..... 271/127, 160, 271/126, 152, 117

(56) References Cited

U.S. PATENT DOCUMENTS 5,078,380 A * 1/1992 Kitazawa ..... 271/9.05
6,059,282 A * 5/2000 Jang ..... 271/160
6,422,773 B1 * 7/2002 Lim ..... 400/710

FOREIGN PATENT DOCUMENTS

| | | |
|---|---|---|
| JP | A 5-4733 | 1/1993 |
| JP | A 5-229674 | 9/1993 |
| JP | A 11-29226 | 2/1999 |

* cited by examiner

*Primary Examiner*—Donald P. Walsh
*Assistant Examiner*—Kaitlin Joerger
(74) *Attorney, Agent, or Firm*—Oliff & Berridge, PLC

(57) ABSTRACT

A sheet feeder has a sheet tray for storing sheets, a moving bottom plate being disposed on the bottom of the sheet tray for stacking the sheets, the moving bottom plate being elastically urged by an elastic member, a sheet delivery unit having a sheet delivery member being placed in contact with the sheet stored in the sheet tray for delivering the sheets in order from the top through the sheet delivery member, and an interlock mechanism for regulating a move of the moving bottom plate in response to the sheet stack amount so as to keep constant the contact relationship between the top sheet position of the sheets stored in the sheet tray and the sheet delivery member.

18 Claims, 11 Drawing Sheets

SHEET FEEDER AND IMAGE FORMATION APPARATUS

BACKGROUND OF THE INVENTION

1. Field of the Invention

This invention relates to a sheet feeder used with an image formation apparatus such as a copier or a printer and in particularly to improvement in a sheet feeder of the type wherein sheets are pushed up and supported on a moving bottom plate and are delivered in order from the top, and an image formation apparatus using the sheet feeder.

2. Description of the Related Art

Generally, in an image formation apparatus such as a copier or a printer, an image formed in an image formation section is transferred to a sheet of paper, etc., and thus usually a sheet feeder for supplying sheets to the image formation section is provided.

Available as this kind of sheet feeder in a related art is a sheet feeder having a sheet tray for storing sheets and a sheet delivery unit disposed above the sheet tray for delivering the sheets in order from the top through the sheet delivery unit.

The sheet delivery unit includes, for example, a pickup roll for delivering sheets and a handling mechanism (for example, made up of a feed roll and a retard roll) for handing the delivered sheets one at a time.

By the way, this kind of sheet feeder adopts a bottom plate lift system to deliver the sheets in the sheet tray.

In the bottom plate lift system, a bottom plate is liftably disposed on the bottom of a sheet tray and sheets are pushed up and supported on the bottom plate, whereby the top sheet is pressed against a pickup roll of a sheet delivery unit, and the sheet is delivered by means of the pickup roll and then is introduced into a handling mechanism for handling the sheets one at a time.

By the way, in this kind of bottom plate lift system, an apparatus, for example, including a drive source such as a motor, and a drive force transmission mechanism for transmitting the drive source from the drive source to a bottom plate, for lifting up the bottom plate in response to the remaining amount of sheets stacked on the bottom plate, is already proposed (for example, refer to JP-A-5-4733, JP-A-5-229674, etc.,). Since this kind of bottom plate lift system requires the drive source and its drive force transmission mechanism and further a sheet remaining amount sensing system, the costs are increased accordingly.

An apparatus wherein the drive source of a motor, etc., is replaced with an elastic member of a spring, etc., is also already proposed (for example, refer to JP-A-11-29226); however, to handle sheets of various sizes and paper qualities, the lift amount of the bottom plate varies as the sheet weight differs, and the sheet delivery operation of a pickup roll easily becomes unstable.

Then, to solve such a problem effectively, the bottom plate lift amount must be controlled delicately, leading to a technical problem of complicating the control mechanism of the bottom plate lift amount.

SUMMARY OF THE INVENTION

It is therefore an object of the invention to provide a sheet feeder for making it possible to stabilize the sheet delivery operation in a simple configuration and an image formation apparatus using the sheet feeder.

According to the invention, there is provided a sheet feeder including: a sheet tray for storing sheets; a moving bottom plate being disposed on a bottom of the sheet tray for stacking the sheets; an elastic member for elastically urging the moving bottom plate; a sheet delivery unit having a sheet delivery member being placed in contact with the sheet stored in the sheet tray for delivering the sheets in order from the top through the sheet delivery member; and an interlock mechanism for regulating a move of the moving bottom plate in response to the sheet stack amount so as to keep substantially constant the contact relationship between the top sheet position of the sheets stored in the sheet tray and the sheet delivery member.

DESCRIPTION OF THE INVENTION

Figure 1:
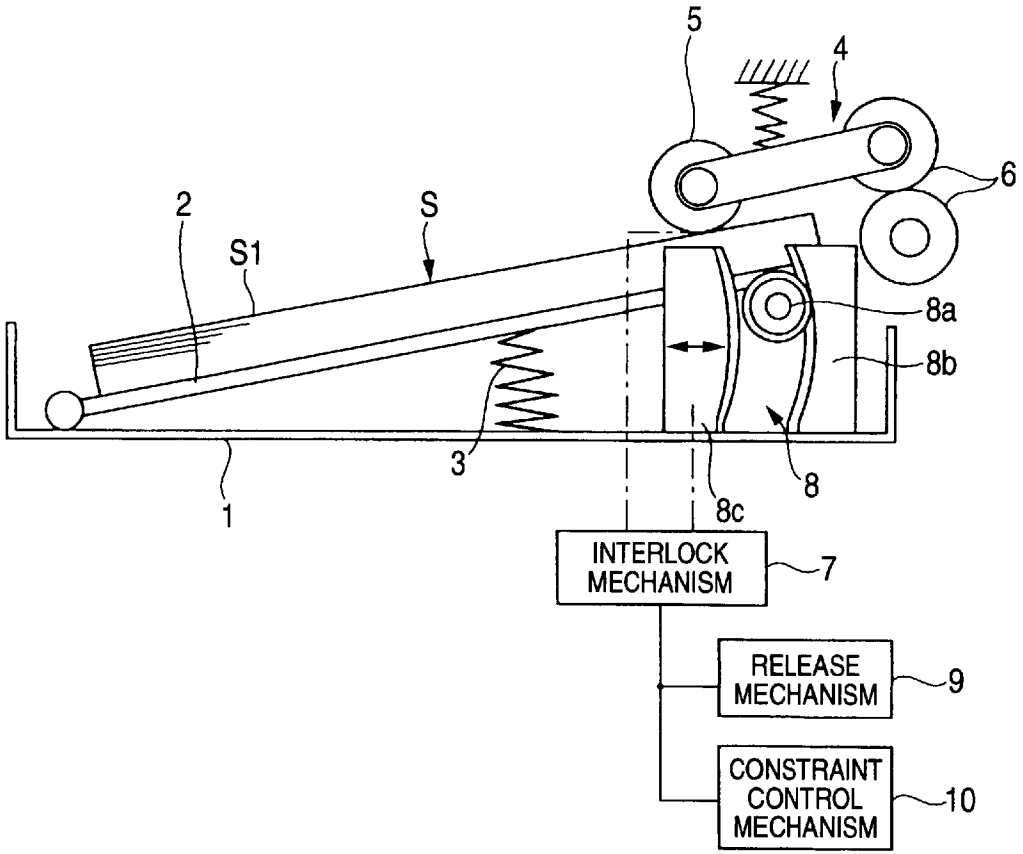
FIG. 1 is a schematic representation to show an outline of a sheet feeder according to the invention.

As shown in FIG. 1, the invention is characterized by the fact that a sheet feeder includes a sheet tray 1 for storing sheets S; a moving bottom plate 2 being disposed on the bottom of the sheet tray 1 for stacking the sheets S, the moving bottom plate being elastically urged by an elastic member 3; a sheet delivery unit 4 having a sheet delivery member 5 being placed in contact with the sheet S stored in the sheet tray 1 for delivering the sheets S in order from the top through the sheet delivery member 5; and an interlock mechanism 7 for regulating a move of the moving bottom plate 2 in response to the sheet S stack amount so as to keep substantially constant the contact relationship between the top sheet S1 position of the sheets S stored in the sheet tray 1 and the sheet delivery member 5.

In such technical means, the moving bottom plate 2 need not necessarily be shaped like a whole plate if it is shaped like a plate capable of stacking sheets; it may be formed with a notch, an opening, etc., whenever necessary.

The moving bottom plate 2 may be made of a material of metal, resin, etc., whenever necessary; preferably a resin material is used from the viewpoint of weight reduction.

Further, the moving bottom plate 2 typically is elastically urged by the elastic member 3 such as a spring, and the disposition point of the elastic member 3 and the number of the elastic members 3 may be selected appropriately.

The sheet delivery unit 4 may includes at least the sheet delivery member 5, but usually, it often includes the handling mechanism 6 for handling the sheets S delivered through the sheet delivery member 5 one at a time.

The sheet delivery member 5 may be shaped like a roll or may be a belt placed on rolls, but it may be changed in design whenever necessary if it is a functional member for delivering the top sheet S1.

On the other hand, the handling mechanism 6 may be not only a combination of a feed member (roll, belt, etc.,) and a retard member (roll, pad, etc.,) having higher surface frictional resistance than the feed member, for example, but also any selected appropriately if it can handle the sheets S one at a time.

Further, the interlock mechanism 7 needs to operate in conjunction so as to keep substantially constant the contact relationship between the top sheet S1 position of the sheets S stored in the sheet tray 1 and the sheet delivery member 5.

The contact relationship between the top sheet S1 and the sheet delivery member 5 is substantially constant and thus the nip pressure of the sheet delivery member 5 relative to the top sheet S1 becomes substantially constant and the sheet S delivery operation becomes stable.

In the interlock mechanism 7, as a representative mode in which "the contact relationship between the top sheet S1 and the sheet delivery member 5 is substantially constant," a move of the moving bottom plate 2 may be regulated in response to the sheet S stack amount so as to keep the top sheet S1 position substantially constant.

In this case, the top sheet S1 position is substantially constant and thus the nip pressure of the sheet delivery member 5 relative to the top sheet S1 becomes substantially constant and the sheet S delivery operation becomes stable.

As a representative mode of the interlock mechanism 7, the interlock mechanism 7 can include a constraint mechanism 8 for constraining the moving bottom plate 2 elastically urged by the elastic member 3 at a predetermined position and a release mechanism 9 for releasing the constraining force of the constraint mechanism 8 if the top sheet S1 position of the sheet tray 1 decreases exceeding a predetermined amount in response to the sheet delivery amount of the sheet delivery member 5, for example.

In this kind of mode, from the viewpoint of maintaining good sheet delivery performance, preferably the sheet delivery unit 4 includes an urging member for urging the sheet delivery member 5 toward the sheets S stacked on the sheet tray 1 and the urging force of the urging member is set smaller than the urging force of the elastic member 3 for elastically urging the moving bottom plate 2.

To grasp the interlock mechanism 7 at a more particular level as a representative mode of the invention, the representative mode of the invention can also be grasped as follows:

As shown in FIG. 1, according to the invention, there is provided a sheet feeder including a moving bottom plate 2 for stacking a plurality of sheets S, the moving bottom plate being urged upward; a sheet delivery unit 4 having a sheet delivery member 5 being placed in contact with the sheet S top face for delivering the sheets S in order from the top through the sheet delivery member 5; a constraint mechanism 8 for constraining an upward move of the moving bottom plate 2 urged upward; and a release mechanism 9 for releasing the constraining force of the constraint mechanism between the instant at which the top sheet S1 position of the sheets S stacked on the moving bottom plate 2 decreases exceeding a predetermined position and the instant at which the top sheet S1 position is restored to the predetermined position or higher.

Alternatively, as shown in FIG. 1, according to the invention, there is provided a sheet feeder including a moving bottom plate 2 for stacking a plurality of sheets S, the moving bottom plate being urged upward; a sheet delivery unit 4 having a sheet delivery member 5 being placed in contact with the sheet S top face for delivering the sheets S in order from the top through the sheet delivery member 5; a constraint mechanism 8 for constraining an upward move of the moving bottom plate 2 urged upward; and a constraint control mechanism 10 for releasing the constraint of the moving bottom plate 2 by the constraint mechanism 8 in association with the sheet delivery member 5 arriving at a first position with a decrease in the number of the sheets S and starting the constraint of the moving bottom plate 2 by the constraint mechanism 8 in association with the sheet delivery member 5 arriving at a second position above the first position.

To grasp the interlock mechanism 7 more directly from another viewpoint, the interlock mechanism 7 may regulate a move of the moving bottom plate 2 in response to the sheet stack amount so as to keep substantially constant the nip pressure of the sheet delivery member 5 relative to the sheets S stacked on the sheet tray 1.

In this case, the nip pressure described above is substantially constant and thus the sheet S delivery operation becomes stable.

Further, the interlock mechanism 7 may be provided on one side of the moving bottom plate 2 in the width direction thereof; from the viewpoint of stably holding the attitude of the moving bottom plate 2, preferably a pair of the interlock mechanisms 7 is placed on both sides of the moving bottom plate 2 in the width direction thereof.

As a representative mode of the interlock mechanism 7, the interlock mechanism 7 can includes a contact interlock section for abutting a support member for supporting the sheet delivery member 5 and interlocking with the support member.

The support member mentioned here includes not only a member for supporting the sheet delivery member 5, but also a member integrally attached to the member for supporting the sheet delivery member 5.

On the other hand, preferably the contact interlock section is abutted against the support member in a manner in which it can be brought away from the support member, and is elastically urged toward the support member.

In this mode, the positional relationship between the contact part between the sheet delivery member 5 and the top sheet S1 and a predetermined part of the support member is substantially constant and thus if the contact interlock section abutting the support member and interlocking therewith is provided, the contact part position between the sheet delivery member 5 and the top sheet S1 can be grasped indirectly.

As a representative mode of the interlock mechanism 7, the interlock mechanism 7 can includes a constraint mechanism 8 for constraining the position of the moving bottom plate 2 when the contact relationship between the sheet delivery member 5 and the top sheet S1 satisfies any desired condition.

Here, the constraint mechanism 8 may include an engagement member being placed on the moving bottom plate 2 and moving as the moving bottom plate 2 moves, and a fixing member for fixing the move of the engagement member until the top sheet S1 position of the sheet tray 1 decreases a predetermined amount in response to the sheet delivery amount of the sheet delivery member 5.

As a more particular mode, the constraint mechanism 8 can includes a gear 8a supported on the moving bottom plate 2 for rotation, a guide rack 8*b* for meshing with the gear 8*a*, and a fixing member 8*c* for fixing rotation of the gear 8*a* when the contact relationship between the sheet delivery member 5 and the top sheet S1 satisfies any desired condition.

Further, if the gear 8*a* forming a part of the constraint mechanism 8 is provided with a buffer member, motion of the gear 8*a* can be slackened for relaxing shock between the gear 8*a* and the fixing member 8*c*.

Further, preferably a gear 8*a* support shaft is placed on the lower side of the moving bottom plate 2 as a reinforcing member.

According to this mode, the gear 8*a* support shaft can be used to enhance the rigidity of the moving bottom plate 2.

Thus, it is made possible to manufacture the moving bottom plate 2 itself in a low-rigidity resin.

To adopt the constraint mechanism 8 in the mode in which a pair of the interlock mechanisms 7 is placed on both sides of the moving bottom plate 2 in the width direction thereof, the gear 8*a* may be provided at each of both ends of the gear 8*a* support shaft.

However, if the constraint mechanism 8 is adopted in the mode in which the interlock mechanism 7 is provided only on one side of the moving bottom plate 2 in the width direction thereof, the gear 8*a* may be provided at each of both ends of the gear 8*a* support shaft.

In doing so, the width direction (shaft direction) balance of the moving bottom plate 2 can be kept and it becomes easy to keep the attitude of the moving bottom plate 2 in the width direction thereof horizontal. In addition, if the constraint mechanism 8 is placed on either side of the sheet feeder, it is made possible to use either gear 8*a*, and the general versatility of the moving bottom plate 2 can be enhanced accordingly.

Further, in the mode in which the gear 8*a* support shaft is placed on the moving bottom plate 2 as a reinforcing member, preferably an urging point of the elastic member 3 is provided in the proximity of the shaft.

According to the mode, the rigidity of the moving bottom plate 2 in the vicinity of the urging point of the elastic member 3 can be enhanced for preventing the moving bottom plate 2 from becoming deformed.

The invention is intended not only for the sheet feeders, but also an image formation apparatus incorporating each sheet feeder described above.

DETAILED DESCRIPTION OF THE PREFERRED EMBODIMENTS

Referring now to the accompanying drawings, there are shown preferred embodiments of the invention.

Figure 2:
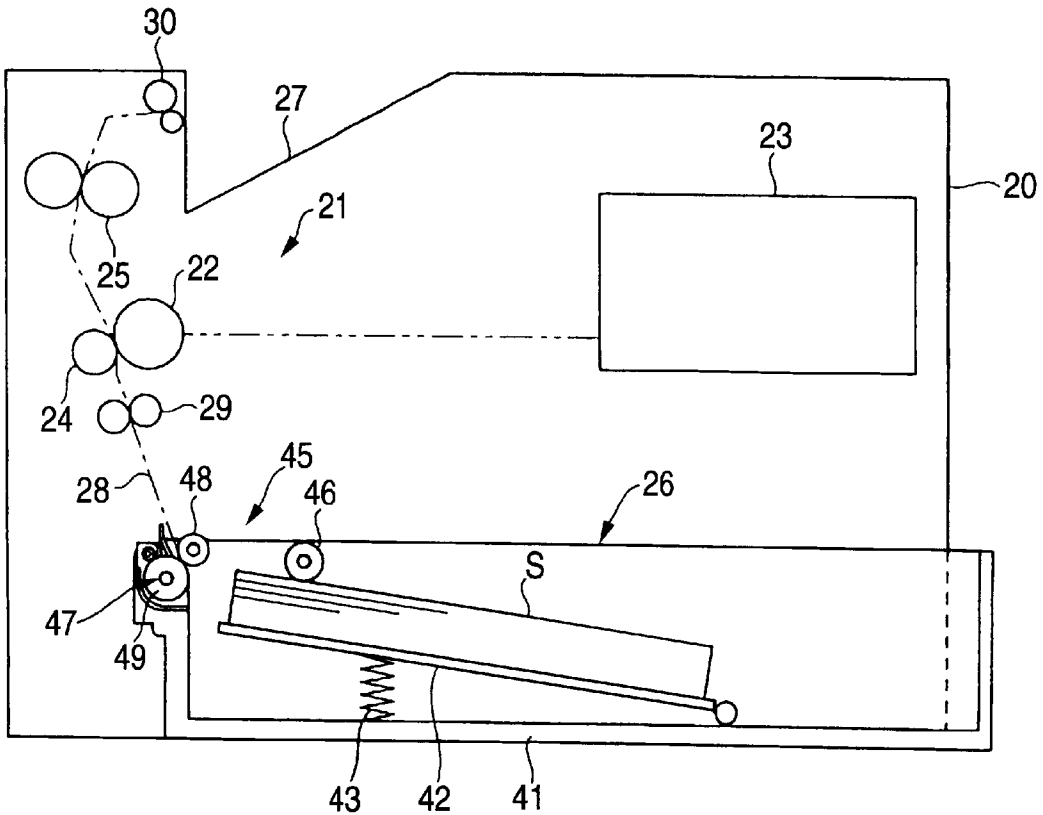
FIG. 2 is a schematic representation to show the general configuration of an image formation apparatus incorporating a first embodiment of a sheet feeder according to the invention.

First Embodiment:

FIG. 2 is a schematic representation to show the general configuration of an image formation apparatus incorporating a first embodiment of a sheet feeder incorporating the invention.

In the figure, the image formation apparatus includes an electrophotographic imaging engine 21, for example, installed in an apparatus main unit 20, a sheet feeder 26 placed below the imaging engine 21 in the apparatus main unit 20, an ejection tray 27 formed on the top of the apparatus main unit 20, and a sheet transport passage 28 provided in a substantially vertical direction on the rear in the apparatus main unit 20 (corresponding to the left in FIG. 2) for transporting a sheet S delivered from the sheet feeder 26 to the imaging engine 21 and the ejection tray 27.

In the embodiment, the imaging engine 21 includes a photoconductor drum 22, a light exposure unit 23 such as a laser scanner for writing an electrostatic latent image onto the charged photoconductor drum 22, a transfer unit 24 for transferring a visible image (toner image) on the photoconductor drum 22 to the sheet S, and a fuser 25 for fixing an unfixed image transferred onto the sheet S.

The photoconductor drum 22 is surrounded by electrophotographic devices (not shown) such as a charger for charging the photoconductor drum 22, a developing unit for visualizing the electrostatic latent image on the photoconductor drum 22 in toner, and a cleaning unit for cleaning the remaining toner on the photoconductor drum 22.

A registration roll 29 for registering and transporting the sheet S which is placed in the sheet transport passage 28 upstream from the photoconductor drum 22, the fuser 25 is disposed in the sheet transport passage 28 downstream from the photoconductor drum 22, and an ejection roll 30 is placed just before the ejection tray 27.

Further, in the embodiment, the sheet feeder 26 includes a sheet tray 41 for storing sheets S, which is disposed drawably into and from a tray reception section of the apparatus main unit 20.

A bottom plate 42 is disposed in a bottom part 41*a* of the sheet tray 41. One end of the bottom plate 42 is placed in contact with the bottom part 41*a* of the sheet tray 41 as a pivot part 42*a* and a part distant from the pivot part 42*a* (part positioned on the sheet delivery direction side) is urged and supported by one or more elastic springs 43 (one in the figure).

The sheets S stacked on the bottom plate 42 are positioned by a guide member (not shown).

Further, a sheet delivery unit 45 is disposed above the sheet tray 41 on the sheet delivery direction side.

The sheet delivery unit 45 includes a pickup roll 46 being placed in contact with a top sheet S1 of the sheets S for delivering the sheet S1 and a handling mechanism 47 for handling the sheets S delivered by the pickup roll 46 one at a time.

In the example, the handling mechanism 47 includes a feed roll 48 and a retard roll 49 having higher surface frictional resistance than the feed roll 48, the rolls 48 and 49 being rotated in contact with each other.

The pickup roll 46 is supported for rotation on the free end side of a swing arm 50 swingable with a shaft of the feed roll 48 as a swing point. The swing arm 50 is formed with a projection piece 51 extending in a horizontal direction, and a downward urging force of an urging spring 52 acts on the projection piece 51 for pressing the pickup roll 46 against the top sheet S1 at a predetermined nip pressure. The urging force of the urging spring 52 is set smaller than that of the elastic spring 43.

Particularly, in the embodiment, a pair of interlock mechanisms 60 for regulating a move of the bottom plate 42 in response to the stack amount of the sheets S is disposed on both sides on the sheet delivery direction side of the sheet tray 41. One interlock mechanism 60 is not shown.

In the embodiment, the interlock mechanism 60 includes a gear 63 placed on the bottom plate 42 for rotation, a guide rack 66 being fixedly placed on a side of the sheet tray 41, the guide rack 66 with which the gear 63 meshes, and a constraint ratchet 67 being movably placed on the side of the sheet tray 41 for constraining rotation of the gear 63 provided that the constraint ratchet 67 meshes with the gear 63.

Figure 3:
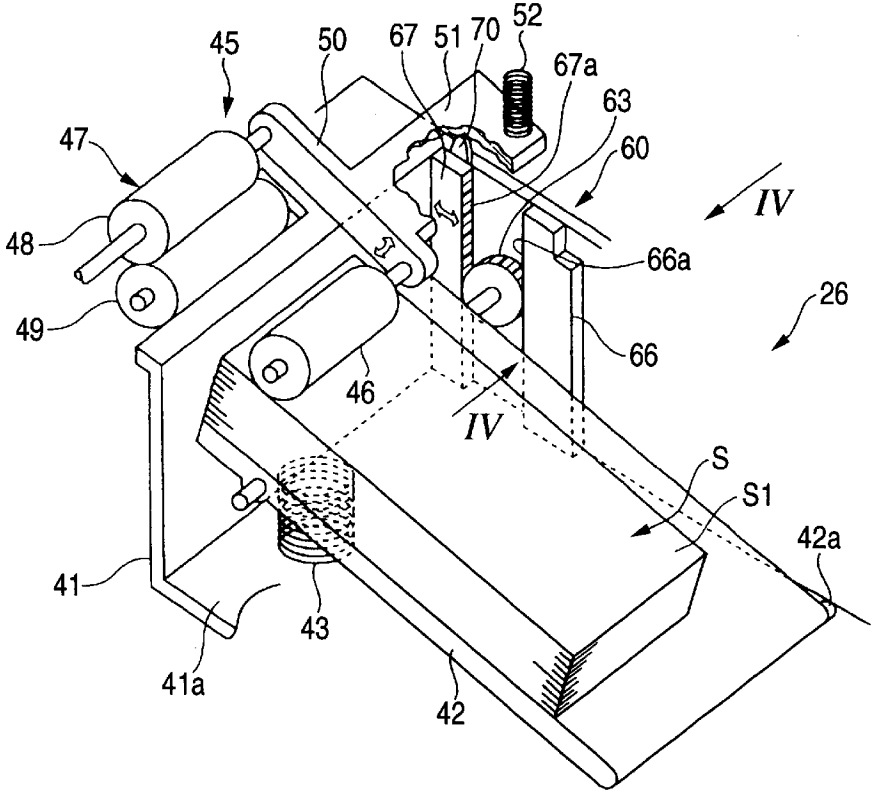
FIG. 3 is a partially perspective view of the sheet feeder according to the first embodiment of the invention.
Figure 5A:
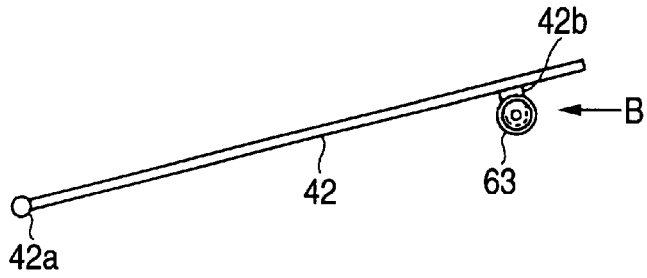
FIG. 5A is a schematic representation to show a bottom plate used in the first embodiment of the invention.
Figure 5B:
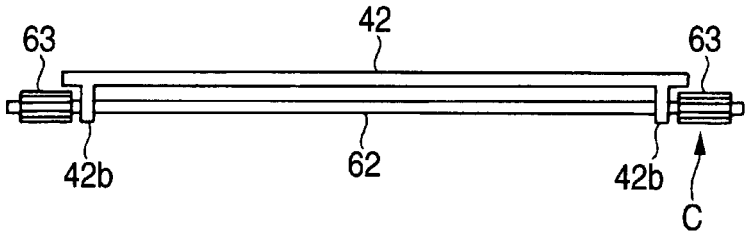
FIG. 5B is a view from B direction in FIG. 5A.

In the example, as shown in FIG. 3, FIG. 5A and FIG. 5B, a pair of support pieces 42*b* are placed in both side parts of the lower face of the bottom plate 42 distant from the pivot part 42*a* and a rotation shaft 62 is placed on the support pieces 42*b* along the width direction of the bottom plate 42 for rotation and is formed at each end with the gear 63.

Figure 5C:
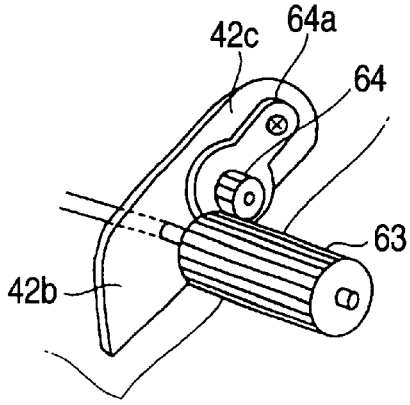
FIG. 5C is a detailed drawing from C direction in FIG. 5B.

One support piece 42*b* of the bottom plate 42 is formed with an extension part 42*c* as shown in FIG. 5C and an oil damper 64 as a buffer is fixed to the extension part 42*c* via a bracket 64*a* and meshes with the gear 63 for slackening motion of the gear 63.

In the embodiment, the rotation shaft 62 is placed on the lower face of the bottom plate 42 and thus acts as a reinforcing member of the bottom plate 42 for enhancing the rigidity of the bottom plate 42 in the periphery of the rotation shaft 62.

Further, in the example, the urging point of the elastic spring 43 is set in a high-rigidity portion of the bottom plate 42 positioned in the proximity of the rotation shaft 62 and thus the bottom plate 42 does not become deformed unnecessarily.

Figure 6:
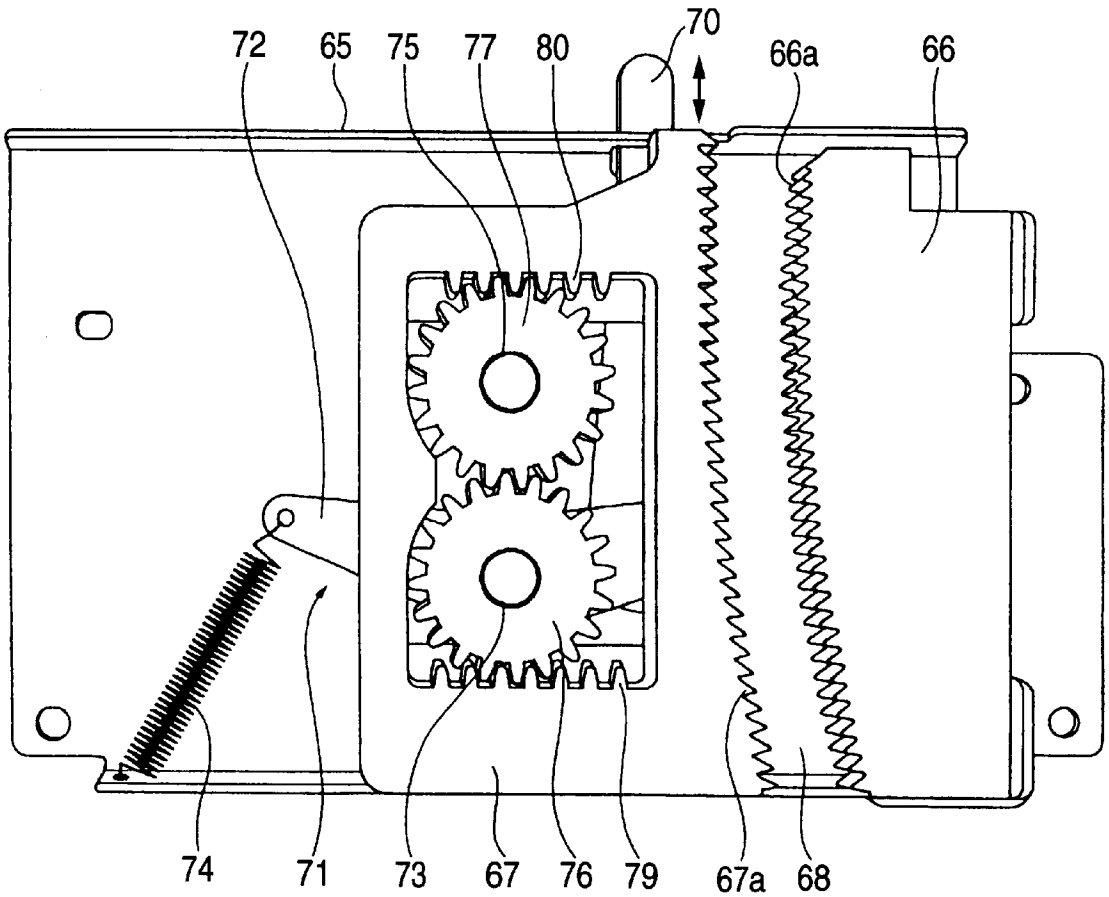
FIG. 6 is a schematic representation to show an interlock mechanism used in the first embodiment of the invention in detail and is a view from VI direction in FIG. 3.
Figure 7:
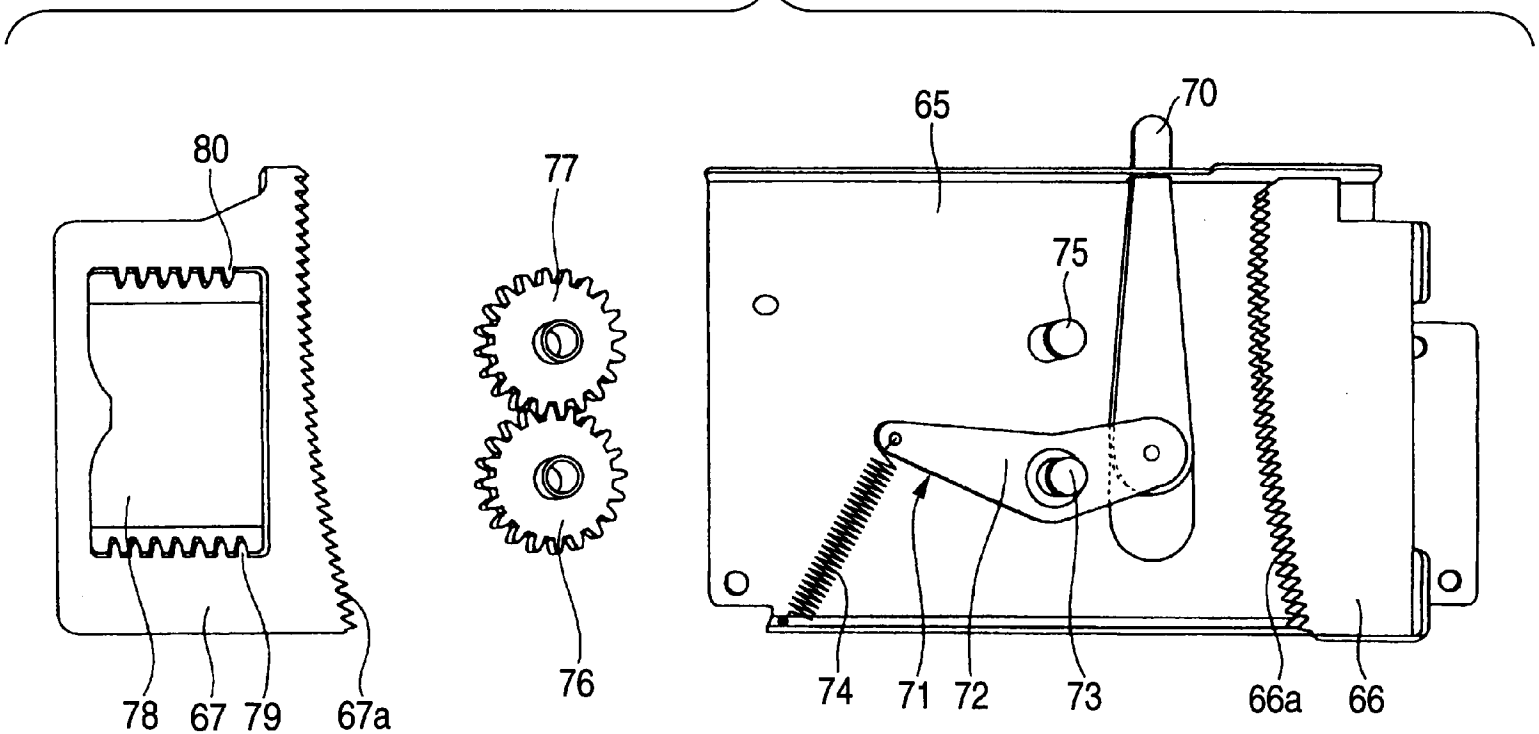
FIG. 7 is an exploded view of the interlock mechanism used in the first embodiment of the invention.

As shown in FIGS. 6 and 7, the guide rack 66 and the constraint ratchet 67 forming the interlock mechanism 60 are held on a holder plate 65, which is fixedly secured to a side wall of the sheet tray 41 with a retaining member of a screw, etc., (not shown).

The guide rack 66 is fixedly secured to the holder plate 65 is formed on one side with rack teeth 66*a* meshing with the gear 63 and the arrangement line of the rack teeth 66*a* becomes slightly a curve so that the pivot part 42*a* of the bottom plate 42 is kept in contact with the bottom of the sheet tray 41.

On the other hand, the constraint ratchet 67 is disposed movably back and forth relative to the holder plate 65, is placed facing the guide rack 66 with a space in which at least the gear 63 intervenes between the constraint ratchet 67 and the guide rack 66, and includes ratchet pawl 67*a* on one side opposed to the rack teeth 66*a* of the guide rack 66.

Further, the interlock mechanism 60 has an actuator 70 abutting the projection piece 51 of the swing arm 50 and moving up and down in a part opposed to the projection piece 51.

The actuator 70 is joined to the constraint ratchet 67 through a conversion mechanism 71 for converting the up and down motion of the actuator 70 into the back and forth motion of the holder plate 65.

The conversion mechanism 71 includes a link arm 72 attached to the holder plate 65 via a rotation pivot 73. The lower end part of the actuator 70 is joined to one arm part end of the link arm 72 by a pin and an urging spring 74 is placed between an opposite arm part end of the link arm 72 and the holder plate 65 for urging the link arm 72 in a direction in which the actuator 70 projects upward.

Further, as the conversion mechanism 71, a fix pivot 75 is placed in the proximity of the rotation pivot 73, a transmission gear 76 is fixedly secured to the rotation pivot 73, and a transmission gear 77 is fitted to the fix pivot 75 for rotation for meshing the transmission gears 76 and 77.

As the conversion mechanism 71, a through opening 78 shaped substantially like a rectangle is made in the constraint ratchet 67 and racks 79 and 80 meshing with the transmission gears 76 and 77 are formed in the upper and lower margins of the through opening 78.

Figure 8:
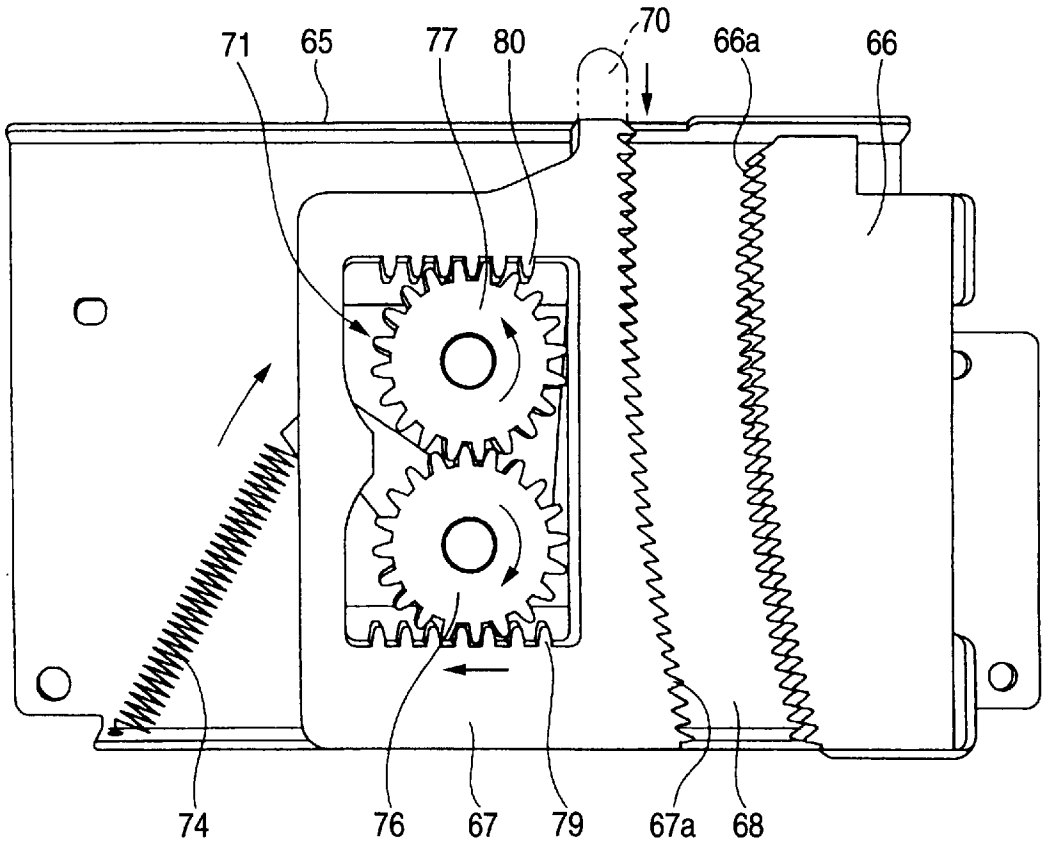
FIG. 8 is a schematic representation to show the operation state of the interlock mechanism used in the first embodiment of the invention.

In the interlock mechanism 60 according to the embodiment, as shown in FIG. 8, if the actuator 70 moves down from the phantom Lime position, the Limk arm 72 rotates in the arrow direction against the urging spring 74 in association with the actuator 70, the transmission gear 76 and the transmission gear 77 meshing therewith rotate in the arrow direction with the rotation of the Limk arm 72, and the transmission gears 76 and 77 and the racks 79 and 80 in the constraint ratchet 67 mesh with each other and move, whereby the constraint ratchet 67 moves in a direction away from the guide rack 66.

In this state, the constraint ratchet 67 and the gear 63 on the bottom plate 42 side are disengaged from each other and the rotation constraint of the gear 63 by the constraint ratchet 67 is released, and the gear 63 is kept in a free rotation state.

When the actuator 70 arrives at an upward projecting position, the constraint ratchet 67 moves in a direction approaching the guide rack 66 and when the constraint ratchet 67 engages the gear 63 on the bottom plate 42 side, it constrains rotation of the gear 63.

Next, the operation of the image formation apparatus according to the embodiment will be discussed centering on the sheet feeder with reference to FIGS. 2 to 8.

Figure 4:
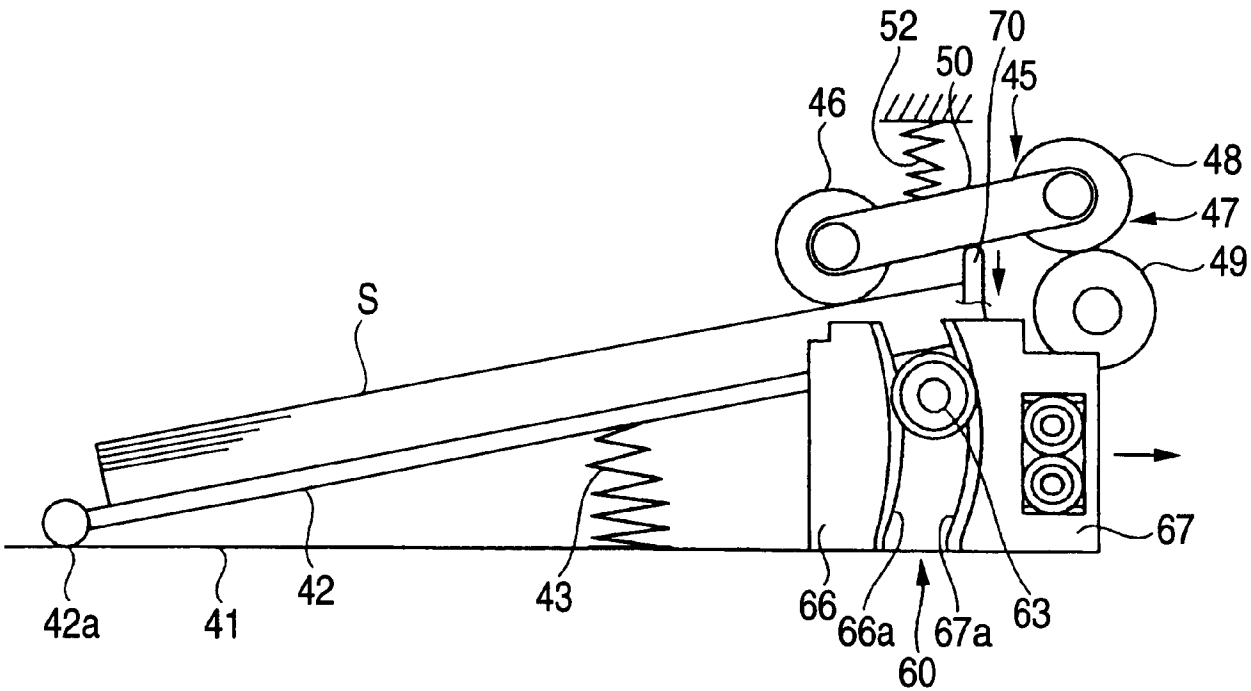
FIG. 4 is a view from IV direction in FIG. 3.

For example, in FIG. 4, when the sheets S are supplied in order by the sheet delivery unit 45, the number of the sheets S stacked on the bottom plate 42 is decreased gradually.

Then, the sheet delivery unit 45 is pressed downward by the urging force of the urging spring 52 and thus the position of the pickup roll 46 lowers below a predetermined position as the number of the sheets S is decreased.

In this state, the projection piece 51 of the swing arm 50 of the sheet delivery unit 45 lowers below a predetermined position and accordingly the actuator 70 moves down as shown in FIG. 8 from the projection position (see FIG. 6) and the constraint ratchet 67 moves in a direction away from the guide rack 66.

Then, the rotation constraint of the gear 63 on the bottom plate 42 side by the constraint ratchet 67 is released, and the gear 63 is placed in a free rotation state.

In this state, the bottom plate 42 is lifted up by the urging force of the elastic spring 43.

At this time, the pickup roll 46 is pushed upward via the sheets S stacked on the bottom plate 42 and accordingly the swing arm 50 is also pushed upward, so that the actuator 70 abutting the projection piece 51 of the swing arm 50 is also lifted up by the urging force of the urging spring 74.

Then, the constraint ratchet 67 is brought close to the guide rack 66 side and engages the gear 63 on the bottom plate 42 side for constraining rotation of the gear 63.

At this stage, the position of the bottom plate 42 is constrained, the position of the top sheet S1 of the sheets S stacked on the bottom plate 42 is always kept substantially constant, the nip pressure of the pickup roll 46 against the top sheet S1 becomes substantially constant, and the delivery operation of the sheets S by the pickup roll 46 is performed stably.

The sheets S delivered from the pickup roll 46 are handled one at a time by the handling mechanism 47 and then are transported to the sheet transport passage 28 shown in FIG. 2.

Whenever a predetermined amount of the sheets S is decreased, similar operation is repeated and the rotation constraint of the gear 63 by the constraint ratchet 67 is released as the amount of the sheets S is decreased. After the bottom plate 42 moves up, again rotation of the gear 63 is constrained by the constraint ratchet 67 and the position of the bottom plate 42 is constrained so that the position of the top sheet S1 of the sheets S stacked on the bottom plate 42 is made substantially constant.

Further, the sheet S delivered from the sheet feeder is transported upward through the sheet transport passage 28 and is registered by the registration roll 29 and then the visible image (toner image) on the photoconductor drum 22 is transferred onto the sheet S in the transfer nip area between the photoconductor drum 22 and the transfer unit 24. Then, the image on the sheet S is fixed by the fuser 25 and the sheet S is ejected through the ejection roll 30 to the ejection tray 27.

In such an imaging process, the supply operation of the sheet S by the sheet feeder, particularly the delivery operation of the sheet S by the pickup roll 46 becomes extremely stable, so that imaging mistakes depending on a supply failure of the sheet S in the sheet feeder can be decreased drastically.

Particularly, in the embodiment, a pair of the interlock mechanisms 60 is placed on both sides of the bottom plate 42, so that it is made possible to stably support the bottom plate 42, the attitude of the bottom plate 42 in the width direction thereof is kept horizontal, and a skew of the sheet S accompanying one-sided deformation of the bottom plate 42 can be prevented effectively.

Next, preferred setup conditions of nip pressure Wn of the pickup roll 46 in a model (see FIG. 9) corresponding to the sheet feeder according to the embodiment will be discussed.

Figure 9:
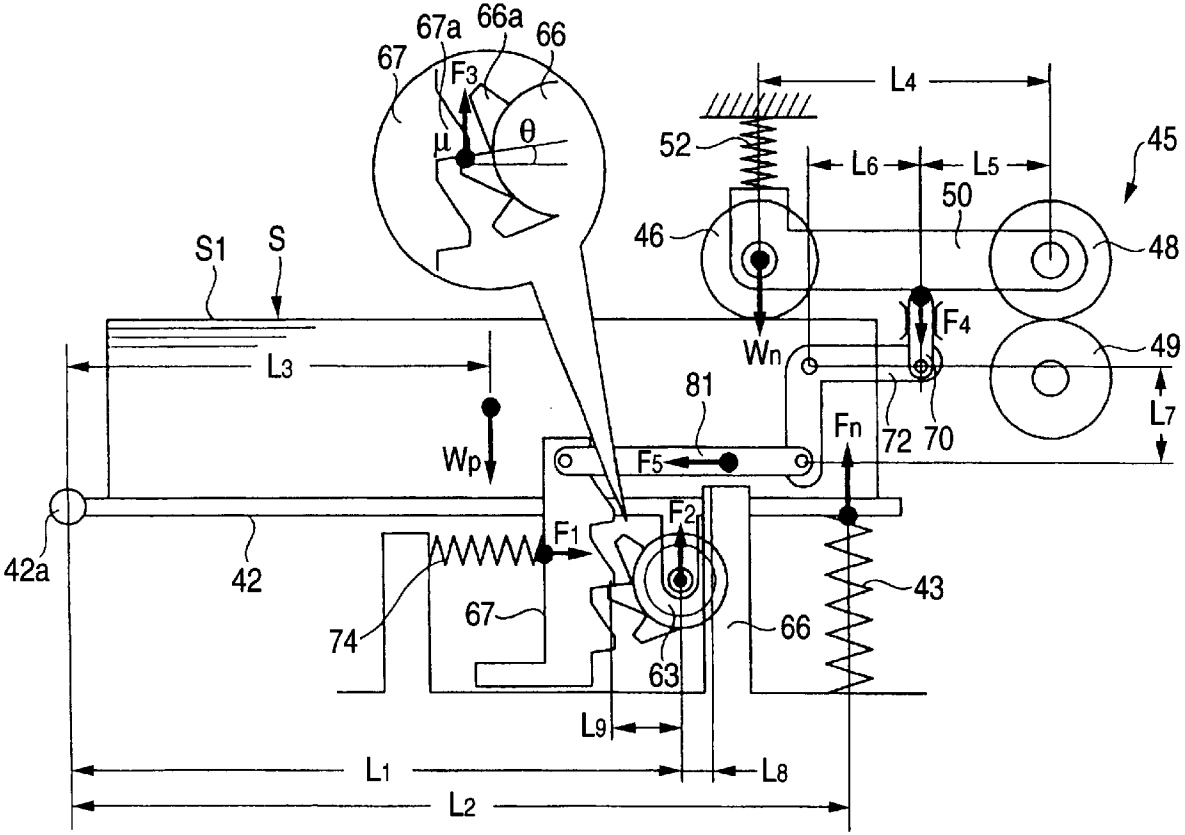
FIG. 9 is a schematic representation to show forces acting on parts in a model corresponding to the sheet feeder according to the first embodiment of the invention.

Components similar to those previously described with reference to FIG. 3 are denoted by the same reference numerals in FIG. 9. In FIG. 9, numeral 81 denotes a transmission rod as a functional member corresponding to the transmission gears 76 and 77 and the racks 79 and 80 of the constraint ratchet 67.

In FIG. 9,

F1: Press pressure of urging spring 74 for stopping motion of constraint ratchet 67;

F2: Force acting on rotation shaft of gear 63;

F3: Force applied to contact between gear 63 and ratchet claw 67*a* of constraint ratchet 67;

F4: Force for pushing down actuator 70;

F5: Force for sliding constraint ratchet 67;

Wp: Weight of sheet S;

Wn: Nip pressure of pickup roll 46;

L1: Distance from pivot part 42*a* of bottom plate 42 to action point of F2;

L2: Distance from pivot part 42*a* of bottom plate 42 to action point of Fn;

L3: Distance from pivot part 42*a* of bottom plate 42 to action point of Wp;

L4: Center-to-center distance between pickup roll 46 and feed roll 48;

L5: Distance from center of feed roll 48 to action point of F4;

L6: Distance from center of pickup roll 46 to action point of F4;

L7: Distance from rotation center of link arm 72 to action point of F5;

L8: Distance from contact between gear 63 and guide rack 66 to action point of F2;

L9: Distance from contact between gear 63 and constraint ratchet 67 to action point of F2;

θ: Contact angle of ratchet claw 67*a* of constraint ratchet 67; and

μ: Frictional coefficient at contact between gear 63 and constraint ratchet 67.

In FIG. 9, $$F2=(L2Fn-L3Wp)/L1 \quad (1)$$

$$F3=(L8/(L8+L9))F2 \quad (2)$$

Figure 10A:
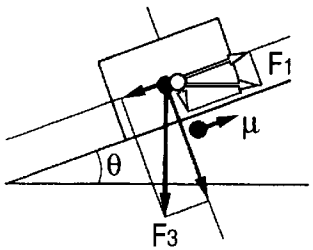
FIG. 10A is a schematic representation to show the condition required for stopping a constraint ratchet by an urging spring and FIG. 10B is a schematic representation to show the condition required for sliding the ratchet member.

The condition for stopping the motion of the constraint ratchet 67 by the urging spring 74 is as shown in FIG. 10A, $$\text{from } F1\cos\theta+\mu(F1\sin\theta+F3\cos\theta)\geqq F3\sin\theta,\ F1(\cos\theta+\mu\sin\theta)\geqq F3\sin\theta-\mu F3\cos\theta=(\sin\theta-\mu\cos\theta)F3\ \therefore F1\geqq\{(\sin\theta-\mu\cos\theta)/(\cos\theta+\mu\sin\theta)\}F3 \quad (3)$$

where from the operation condition of the mechanism, $$F1\geqq 0 \quad (4)$$

Figure 10B:
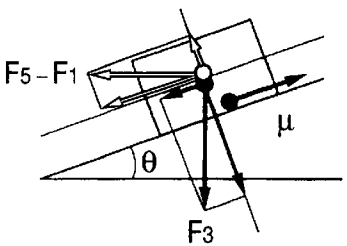

To slide the constraint ratchet 67, as shown in FIG. 10B, $$\text{from } (F5-F1)\cos\theta+F3\sin\theta\geqq\mu(F3\cos\theta-(F5-F1)\sin\theta),\ (F5-F1)(\cos\theta+\mu\sin\theta\geqq\mu F3\cos\theta-F3\sin\theta\ \therefore F5\geqq F1+\{(\mu\cos\theta-\sin\theta)/(\cos\theta+\mu\sin\theta\}F3 \quad (5)$$

At this time, the force F4 for pushing down the actuator 70 is $$F4=(L7/L6)F5 \quad (6)$$

The nip pressure Wn of the pickup roll 46 is $$Wn=(L5/L4)F4=(L5/L4)(L7/L6)F5 \quad (7)$$

Therefore, $$Wn\geqq(L5/L4)(L7/L6)[F1+\{(\mu\cos\theta-\sin\theta)/(\cos\theta+\mu\sin\theta)\}F3] \quad (8)$$

Thus, if the nip pressure Wn of the pickup roll 46 is set, the operation sequence performed by the interlock mechanisms 60 can be realized.

Figure 11:
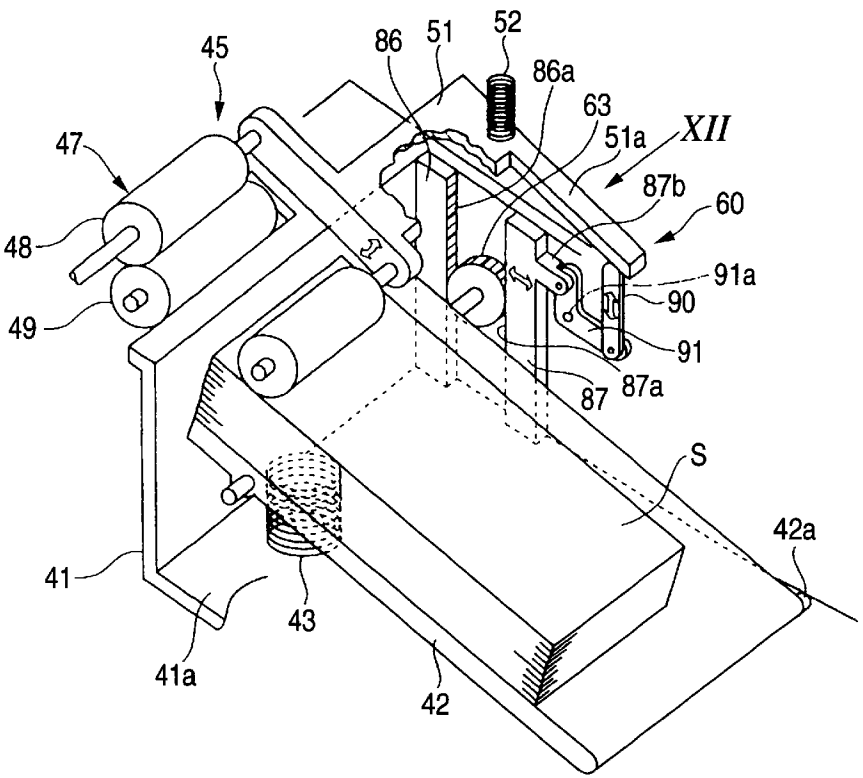
FIG. 11 is a partially perspective view to show a second embodiment of a sheet feeder according to the invention.

Second Embodiment:

FIG. 11 shows a second embodiment of a sheet feeder incorporating the invention.

In the figure, the sheet feeder has substantially the same configuration as that of the first embodiment except for interlock mechanisms 60. Components similar to those of the first embodiment previously described with reference to the accompanying drawings are denoted by the same reference numerals in FIGS. 11 and 12 and will not be discussed in detail again.

Figure 12:
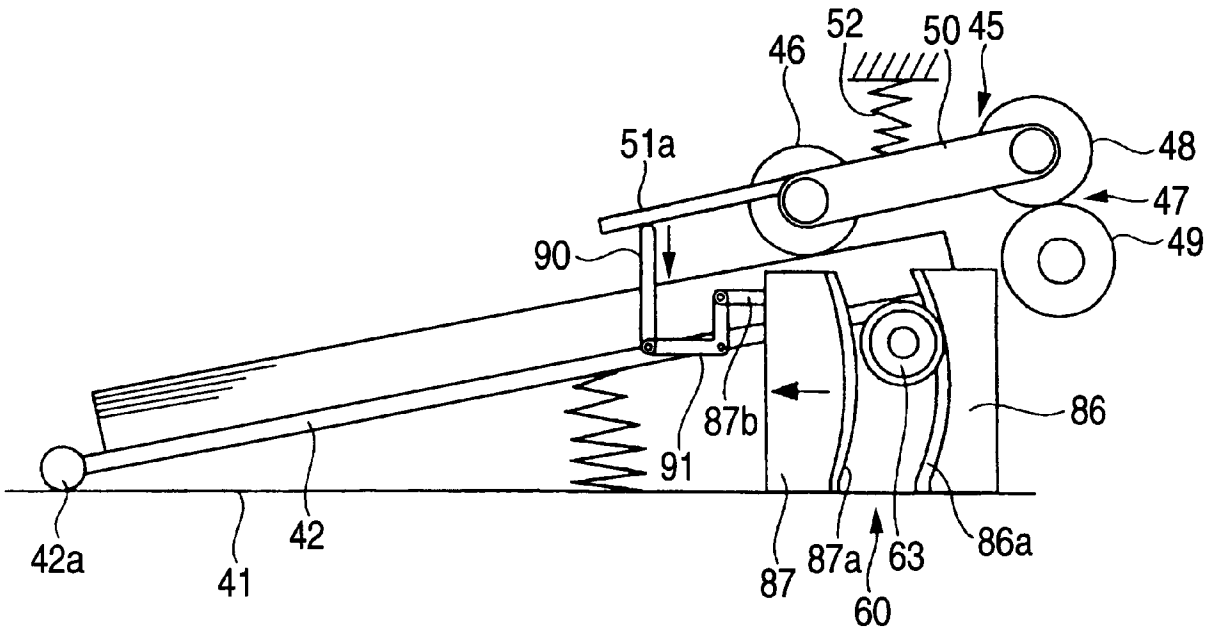
FIG. 12 is a view from XII direction in FIG. 11.

In the second embodiment, as shown in FIGS. 11 and 12, an interlock mechanism 60 includes a gear 63 placed on the side of a bottom plate 42, a guide rack 86 having rack teeth 86*a* meshing with the gear 63, and a constraint ratchet 87 having a ratchet claw 87*a* for constraining rotation of the gear 63. The positional relationship between the guide rack 86 and the constraint ratchet 87 is set opposite to that in the first embodiment in the back and forth relationship, the guide rack 86 is disposed on the sheet delivery direction side of a sheet tray 41, and the constraint ratchet 87 is disposed on the side opposite to the sheet delivery direction side movably in a back and forth direction.

In the embodiment, for example, an extension projection piece 51*a* extending to the side of the sheet tray 41 opposite to the sheet delivery direction side is placed in a part of a projection piece 51 of a swing arm 50 of a sheet delivery unit 45 and an actuator 90 abutting the extension projection piece 51*a* is placed movably up and down. On the other hand, a retention projection piece 87*b* is placed in a part of the constraint ratchet 87, a link arm 91 shaped like a crank is placed between the lower end part of the actuator 90 and the retention projection piece 87*b* of the constraint ratchet 87, and a center part 91*a* of the link arm 91 is supported on a side wall of the sheet tray 41 (not shown) for rotation. The actuator 90 is urged upward by an urging spring (not shown).

Also in the embedment, for example, as shown in FIG. 12, as the number of sheets S stacked on the bottom plate 42 is decreased, the sheet delivery unit 45 is pressed downward by the urging force of an urging spring 52 and thus the position of a pickup roll 46 lowers below a predetermined position as the number of the sheets S is decreased.

In this state, the projection piece 51 of the swing arm 50 of the sheet delivery unit 45 (specifically, the extension projection piece 51*a*) lowers below a predetermined position and accordingly the actuator 90 moves down from the projection position and the constraint ratchet 87 moves in a direction away from the guide rack 86 with rotation of the link arm 91.

Then, the rotation constraint of the gear 63 on the bottom plate 42 side by the constraint ratchet 87 is released, and the gear 63 is placed in a free rotation state.

In this state, the bottom plate 42 is lifted up by the urging force of an elastic spring 43.

At this time, the pickup roll 46 is pushed upward via the sheets S stacked on the bottom plate 42 and accordingly the swing arm 50 is also pushed upward, so that the actuator 90 abutting the projection piece 51 of the swing arm 50 is also lifted up by the urging force of urging spring (not shown)

Then, the link arm 91 rotates in an opposite direction and the constraint ratchet 87 is brought close to the guide rack 86 side and engages the gear 63 on the bottom plate 42 side for constraining rotation of the gear 63.

At this stage, the position of the bottom plate 42 is constrained, the position of the top sheet S1 of the sheets S stacked on the bottom plate 42 is always kept substantially constant, the nip pressure of the pickup roll 46 against the top sheet S1 becomes substantially constant, and the delivery operation of the sheets S by the pickup roll 46 is performed stably.

The sheets S delivered from the pickup roll 46 are handled one at a time by a handling mechanism 47 and then are transported to sheet transport passage 28 shown in FIG. 2.

Whenever a predetermined amount of the sheets S is decreased, similar operation is repeated.

As described above, according to the invention, in the system using the moving bottom plate elastically urged, the interlock mechanism regulates a move of the moving bottom plate so as to keep substantially constant the contact relationship between the top sheet position of the sheets stored in the sheet tray and the sheet delivery member, so that the nip pressure of the sheet delivery member relative to the top sheet can be kept substantially constant.

Thus, the sheet delivery operation can be extremely stabilized in the simple configuration.

What is claimed is:

1. A sheet feeder, comprising:

a sheet tray for storing sheets;

a moving bottom plate being disposed on a bottom of the sheet tray for stacking the sheets;

an elastic member for elastically urging the moving bottom plate;

a sheet delivery unit having a sheet delivery member being placed in contact with the sheets stored in the sheet tray for delivering the sheets in order from the top through the sheet delivery member; and an interlock mechanism for regulating movement of the moving bottom plate in response to the sheet stack amount so as to keep substantially constant the contact relationship between the top sheet position of the sheets stored in the sheet tray and the sheet delivery member.

2. The sheet feeder as claimed in claim 1, wherein the interlock mechanism regulates a move of the moving bottom plate in response to the sheet stack amount so as to keep substantially constant the top sheet position of the sheets stored in the sheet tray.

3. The sheet feeder as claimed in claim 1, wherein the interlock mechanism comprises a constraint mechanism for constraining the moving bottom plate elastically urged by the elastic member at a predetermined position and a release mechanism for releasing the constraining force of the constraint mechanism if the top sheet position of the sheet tray decreases exceeding a predetermined amount in response to the sheet delivery amount of the sheet delivery member.

4. The sheet feeder as claimed in claim 3, wherein the sheet delivery unit comprises an urging member for urging the sheet delivery member toward the sheets stacked on the sheet tray and wherein the urging force of the urging member is set smaller than the urging force of the elastic member for elastically urging the moving bottom plate.

5. A sheet feeder comprising:

a moving bottom plate for stacking a plurality of sheets, the moving bottom plate being urged upward;

a sheet delivery unit having a sheet delivery member being placed in contact with the sheet top face for delivering the sheets in order from the top through the sheet delivery member;

a constraint mechanism for constraining an upward move of the moving bottom plate urged upward; and a release mechanism for releasing the constraining force of the constraint mechanism between the instant at which the top sheet position of the sheets stacked on the moving bottom plate decreases exceeding a predetermined position and the instant at which the top sheet position is restored to the predetermined position or higher.

6. A sheet feeder comprising:

a moving bottom plate for stacking a plurality of sheets, the moving bottom plate being urged upward;

a sheet delivery unit having a sheet delivery member being placed in contact with the sheet top face for delivering the sheets in order from the top through the sheet delivery member;

a constraint mechanism for constraining an upward move of the moving bottom plate urged upward; and a constraint control mechanism for releasing the constraint of the moving bottom plate by the constraint mechanism in association with the sheet delivery member arriving at a first position with a decrease in the number of the sheets and starting the constraint of the moving bottom plate by the constraint mechanism in association with the sheet delivery member arriving at a second position above the first position.

7. The sheet feeder as claimed in claim 1, wherein the interlock mechanism regulates a move of the moving bottom plate in response to the sheet stack amount so as to keep substantially constant the nip pressure of the sheet delivery member relative to the sheets stacked on the sheet tray.

8. The sheet feeder as claimed in claim 1, wherein a pair of the interlock mechanisms is placed on both sides of the moving bottom plate in a width direction thereof.

9. The sheet feeder as claimed in claim 1, wherein the interlock mechanism comprises a contact interlock section which is abuttable to a support member for supporting the sheet delivery member and which interlocks with the support member when the contact interlock section abuts against the support member.

10. The sheet feeder as claimed in claim 9, wherein the contact interlock section is elastically urged toward the support member.

11. The sheet feeder as claimed in claim 1, wherein the interlock mechanism comprises a constraint mechanism for constraining the position of the moving bottom plate when the contact relationship between the sheet delivery member and the top sheet satisfies a predetermined condition.

12. The sheet feeder as claimed in claim 11, wherein the constraint mechanism comprises an engagement member being placed on the moving bottom plate and moving as the moving bottom plate moves, and a fixing member for fixing the move of the engagement member until the top sheet position of the sheet tray decreases a predetermined amount in response to the sheet delivery amount of the sheet delivery member.

13. The sheet feeder as claimed in claim 11, wherein the constraint mechanism comprises a gear supported on the moving bottom plate for rotation, a guide rack for meshing with the gear, and a fixing member for fixing rotation of the gear when the contact relationship between the sheet delivery member and the top sheet satisfies a predetermined condition.

14. The sheet feeder as claimed in claim 13, wherein the gear forming a part of the constraint mechanism is provided with a buffer member to reduce shock between the gear and the fixing member.

15. The sheet feeder as claimed in claim 13, wherein a gear support shaft is placed on the lower side of the moving bottom plate as a reinforcing member.

16. The sheet feeder as claimed in claim 15, wherein the moving bottom plate comprises an urging point of the elastic member in the proximity of the gear support shaft placed as a reinforcing member.

17. The sheet feeder as claimed in claim 1, wherein the sheet delivery unit further comprises a handling mechanism for handling the sheets sent through the sheet delivery member one at a time.

18. An image formation apparatus incorporating a sheet feeder as claimed in claim 1.

* * * * *